United States Patent [19]

Tsunefuji

[11] 4,321,570

[45] Mar. 23, 1982

[54] RELEASE ELECTROMAGNET

[75] Inventor: Katsuhiko Tsunefuji, Hachioji, Japan

[73] Assignee: Olympus Optical Company Ltd., Tokyo, Japan

[21] Appl. No.: 151,375

[22] Filed: May 19, 1980

Related U.S. Application Data

[63] Continuation of Ser. No. 912,051, Jun. 2, 1978.

[30] Foreign Application Priority Data

Oct. 15, 1977 [JP] Japan ..... 52/123889
Oct. 15, 1977 [JP] Japan ..... 52/138437
Oct. 15, 1977 [JP] Japan ..... 52/139423

[51] Int. Cl.[3] ..... H01F 7/08

[52] U.S. Cl. ..... 335/229; 335/85; 335/234

[58] Field of Search ..... 335/229, 230, 234, 236, 335/78, 79, 84, 85

[56] References Cited

U.S. PATENT DOCUMENTS 2,888,290 5/1959 Pierce ..... 335/229

*Primary Examiner*—Harold Broome
*Attorney, Agent, or Firm*—Weinstein & Sutton

[57] ABSTRACT

A release electromagnet comprises a permanent magnet assembly including a pair of yokes disposed in parallel relationship with each other, and a permanent magnet held between the yokes for attracting an armature, a winding disposed on one of the yokes which when energized produces a magnetic flux to reduce the attraction effect upon the armature, and a member of non-magnetic material disposed between and connecting the yokes together to reduce the energy required to release the armature.

24 Claims, 14 Drawing Figures

RELEASE ELECTROMAGNET

This is a continuation of application Ser. No. 912,051, filed June 2, 1978.

BACKGROUND OF THE INVENTION

The invention relates to a release electromagnet, and more particularly, to an electromagnet including a permanent magnet which is effective to attract an armature and wherein the electromagnet produces a magnetic flux to reduce the attraction of the armature upon energization thereof.

A release electromagnet commonly referred to as an electromagnet of permanent magnet core type is used to constrain or release a movable member such as is used in an electrical shutter assembly of a camera. The electromagnet is constructed with a pair of yokes between which a permanent magnet is held in order to attract an armature thereto, and an electromagnet winding is disposed on the yoke to reduce the attraction effect upon the armature which is produced by the permanent magnet. A movable member is held attracted to the electromagnet under the magnetic influence of the permanent magnet, and when it is desired to release the movable member, the winding is energized to oppose the magnetic attraction of the permanent magnet.

Unlike a conventional electromagnet, a release electromagnet holds a movable member attracted thereto under the magnetic influence of a permanent magnet, and thus it is not necessary to maintain a holding current to hold the movable member attracted. The movable member can be released from the constraint by passing an energizing current through a winding disposed on the electromagnet for a short interval, thus achieving a substantial saving in the power dissipation. In addition, such electromagnet can be constructed in a compact manner.

Referring to FIG. 1, a prior art arrangement of a release electromagnet will be described. The electromagnet shown comprises a pair of yokes 1*a*, 1*b* formed of a soft magnetic material such as ferrite or the like in the form of square pillars. The yokes are disposed in parallel relationship with each other, and a small permanent magnet 2 formed of a rare earth metal in a square rod shape is disposed between the lower ends thereof. The end faces of the magnet which form N- and S-poles are adhesively secured to the yokes to be firmly held therebetween, thus forming a permanent magnet assembly 1A. The upper end faces of the yokes 1*a*, 1*b* represent N- and S-poles, which are effective to attract an armature 3 which represents a movable member. A winding 4 is disposed on yoke 1*a*, thus forming an electromagnet.

A spring 5 is anchored to the armature 3 and tends to move it away from the electromagnet. When the armature 3 is to be maintained attracted, a mechanism, not shown, is used to move the armature 3 against the resilience of spring 5 into a region in which the magnetic flux of the assembly 1A is effective to attract it. When the armature is to be released, the winding 4 is energized to counteract the attractive force of the magnet assembly 1A, allowing the armature to be moved away from the end faces 1*c*, 1*d* under the resilience of the spring 5. To achieve such release, it is necessary to pass a current through the winding 4 which is sufficient to produce a magnetic flux counteracting that from the magnet 2. It will be appreciated that the required flux which must be produced by the winding 4 in order to achieve release of the armature will amount to a substantial value, which means a poor release or separation efficiency.

FIG. 2 shows a modification which is proposed to overcome such difficulty. Specifically, the arrangement of FIG. 2 includes a bypass 1*e* which connects the lower ends of the yokes 1*a*, 1*b* so that the flux produced by the winding 4 can pass through the bypass to thereby improve the armature separation efficiency. However, the flux from the permanent magnet 2 will then follow two paths A and B, as shown in FIG. 2. Since a proportion of the flux is diverted to the path B, the remaining flux contained in the path A and thus effective for the purpose of attracting the armature 3, will be reduced. As a consequence, in order to increase the magnitude of the flux which in path A, the cross-sectional area d of the bypass 1 will have to be reduced so as to suppress the diversion of the flux from magnet 2. However, this tends to cause a magnetic saturation thereof upon energization of the winding 4 since the bypass 1*e* forms part of the path for the flux produced by the winding. Thus the alternative shown in FIG. 2 suffers from another disadvantage when it overcomes the first mentioned difficulty.

SUMMARY OF THE INVENTION

It is an object of the invention to provide a release electromagnet including a pair of yokes between which a permanent magnet is held and which are physically connected together through a non-magnetic material interposed therebetween, thereby overcoming the disadvantages of the prior art.

In accordance with the invention, the interposition of the non-magnetic material between the two yokes provides a magnetic circuit which may be exclusively used to pass the flux from the winding and which is substantially free from the influence of the permanent magnet. As compared with the arrangement shown in FIG. 1 in which the current flow through the winding had to be increased in order to overcome an increased reluctance of the magnet, the gap formed by the non-magnetic material in the electromagnet of the invention exhibits a reduced reluctance, which permits desired release of the armature to be achieved with a low power. In addition, the magnetic saturation is avoided, thus improving the efficiency. The efficient operation of the electromagnet with a small current permits the electromagnet to be used in an electrical shutter of the type in which a shutter is electromagnetically released.

DESCRIPTION OF PREFERRED EMBODIMENTS

Figure 1:
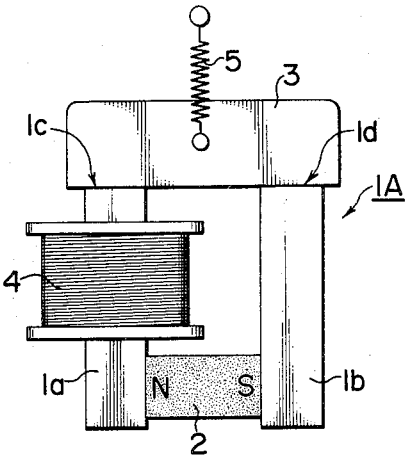
FIG. 1 PRIOR ART
FIGS. 1 and 2 are schematic front views of conventional electromagnets.
Figure 2:
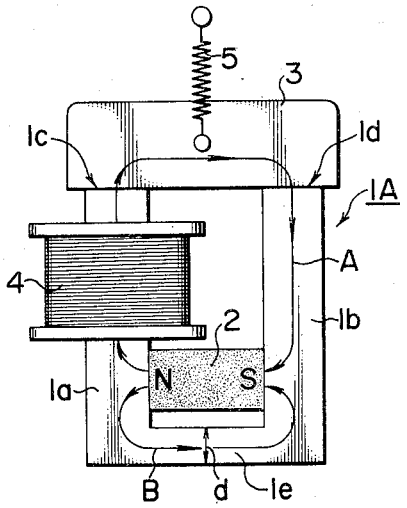
FIG. 2 PRIOR ART
Figure 3:
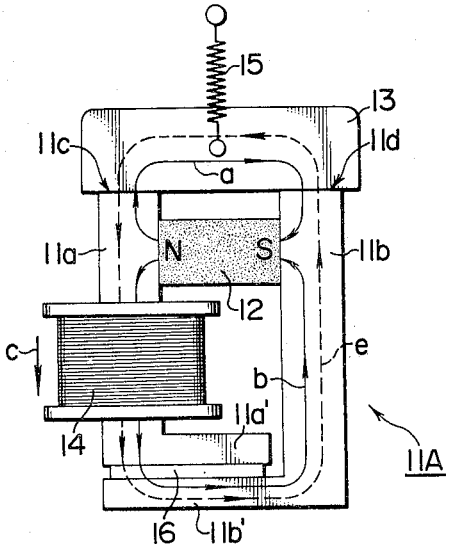
FIG. 3 is a schematic front view of a release electromagnet according to one embodiment of the invention.
Figure 4:
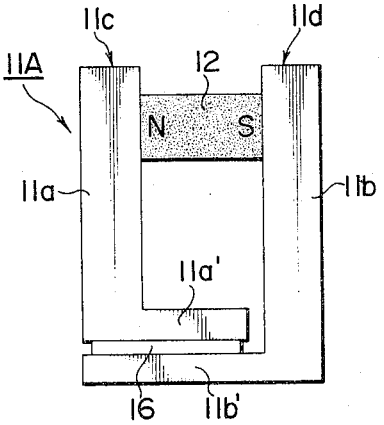
FIG. 4 is a front view of the magnet assembly shown in FIG. 3.

Referring to FIGS. 3 and 4, there is shown a release electromagnet according to the invention which comprises a permanent magnet assembly 11A. The assembly includes an L-shaped yoke 11*a*, a similar L-shaped, but oppositely disposed yoke 11*b*, a permanent magnet 12 and a member 16 of a non-magnetic material. The yoke 11*a* has a horizontally aligned bottom portion 11*a*′ (relative to FIGS. 3 and 4) of a reduced length, and the yoke 11*b* also includes a horizontal bottom portion 11*b*′ which is adapted to be located outside the bottom 11*a*′. The member 16 is interposed between the bottom portions 11*a*′, 11*b*′. The member 16 may comprise a strip of a sheet metal such as copper or aluminum, and can be adhesively secured to the bottom portions. The permanent magnet 12 is disposed between the vertical limbs of the yokes adjacent to their upper ends, and has its opposite end faces which represent N- and S-poles adhesively secured to the limbs. In this manner, upper end faces 11*c*, 11*d* of the yokes serve to attract an armature 13. A winding 14 is disposed on the vertical limb of yoke 11*a*, as shown in FIG. 3, thus completing a release electromagnet. As shown, a spring 15 is engaged with the armature 13 and acts to urge it away from the end faces 11*c*, 11*d*.

In operation, when the winding 14 is not energized, the flux from the permanent magnet 12 follows a closed path a, thus allowing the armature 13 to be attracted against the end faces 11*c*, 11*d*. Flux from the permanent magnet also follows another closed path b including yoke 11*a*, member 16, horizontal bottom portion 11*b*′ and yoke 11*b*, but such fraction of the flux will be greatly reduced as compared with the magnitude of flux following the path a since the path b has a substantially higher reluctance than the path a. Hence there occurs no substantial reduction in the effectiveness of the permanent magnet 12 in attracting the armature 13, thus assuring a positive attraction thereof.

When the winding 14 is energized by a current flow which produces a flux indicated by an arrow c in order to move the armature 13 away from the electromagnet, this flux will follow a closed path e including yoke 11*b*, armature 13 and yoke 11*a*. Though a gap formed by the member 16 is present in this closed path, it does not present a substantial reluctance to the flow of flux produced by the winding 14. Since the flux passes through the armature 13 in the opposite direction from the flux following the path a, there occurs a reduction in the attraction force which allows the armature 13 to be moved away from the end faces 11*c*, 11*d* under the resilience of the spring 15. It will be seen that the reluctance presented by the member 16 is substantially reduced as compared with the reluctance which the flux produced by the winding 14 will have to overcome in order to pass through the permanent magnet. As a consequence, a sufficient field strength is maintained to achieve efficient release of the armature without the accompanying magnetic saturation.

Figure 5:
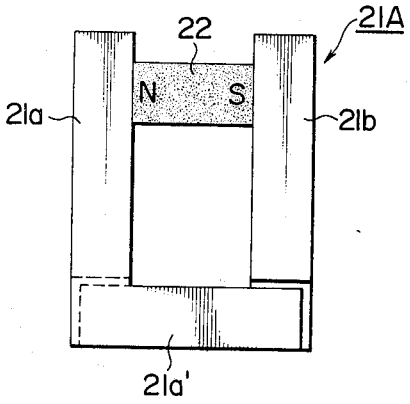
FIG. 5 is a front view of another form of a magnet assembly.
Figure 6:
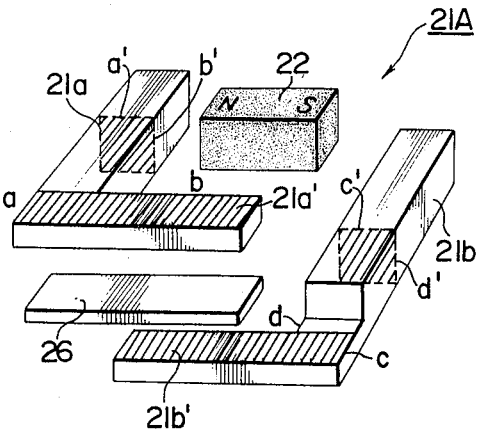
FIG. 6 is an exploded, perspective view of the assembly shown in FIG. 5.
Figure 7:
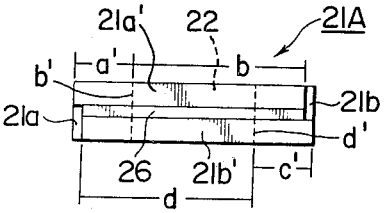
FIG. 7 is a bottom view of the assembly of FIG. 5.

FIGS. 5 to 7 show another form of permanent magnet assembly 21A. It includes a pair of L-shaped yokes 21*a*, 21*b* which are equal in size. The yokes are assembled by inverting one yoke 21*b* inverted with respect to the other so that their horizontal bottom portions 21*a*′, 21*b*′ are juxtaposed, with a member 26 of non-magnetic material interposed therebetween. As shown in FIG. 6, bottom portion 21*a*′ has a first face defined by letters a and b so that the surface area of this first face is a×b. In addition, the yoke 21*a* has a cross-sectional area defined by letters a′ and b′ in a plane normal to the direction of the flux so that the cross-sectional area of the yoke 21*a* is a′×b′. A similar arrangement exists with regard to yoke 21*b* having a cross-sectional area c′×d′ and with regard to bottom portion 21*b*′ having a second face with a surface area c×d. A permanent magnet 22 is held between the vertical limbs of the yokes 21*a*, 21*b*. It will be noted from FIG. 6 that the bottom portions 21*a*′, 21*b*′ have a thickness which is reduced to one-half that of the body of the yokes 21*a*, 21*b* so that when the yokes and the member 26 are assembled together, the entire thickness corresponds to the thickness of either yoke 21*a*, 21*b*. It will be seen that a winding may be disposed on the yoke 21*a* to form a similar release electromagnet as shown in FIG. 3.

Figure 8:
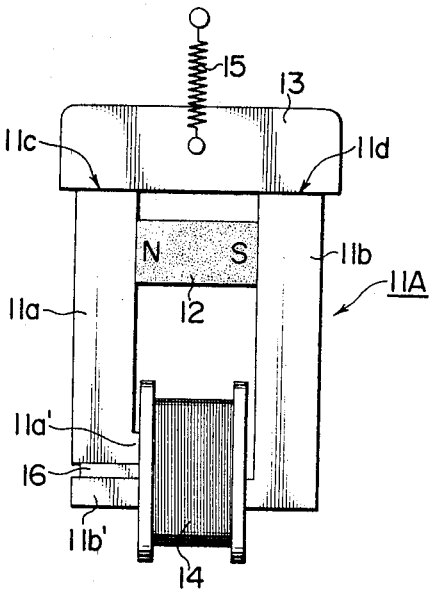
FIG. 8 is a front view of a release electromagnet according to another embodiment of the invention.

FIG. 8 shows another embodiment of the release electromagnet of the invention. It comprises a permanent magnet assembly 11A, armature 13 and tension spring 15, which are quite similar to those shown in FIG. 3. However, the winding 14 is located at a different position. In this embodiment, it is disposed on the horizontal bottom portions 11*a*′, 11*b*′ of the yokes where the member 16 is interposed. This improves the effect of reducing the attractive force on the armature since the flux produced by a current flow through the winding 14 immediately operates on the gap formed by the non-magnetic material 16.

Figure 9:
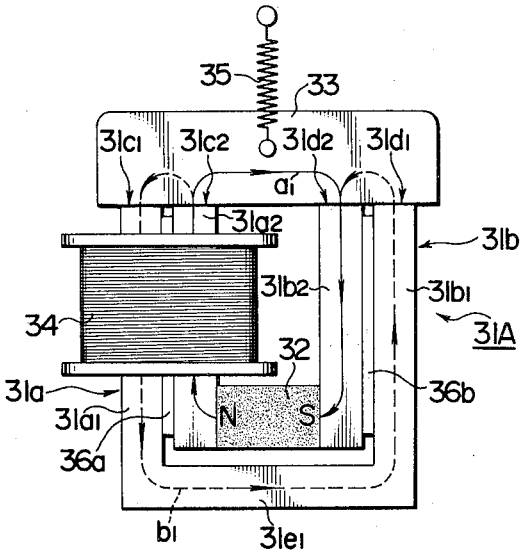
FIG. 9 is a front view of a release electromagnet according to a further embodiment of the invention.
Figure 10:
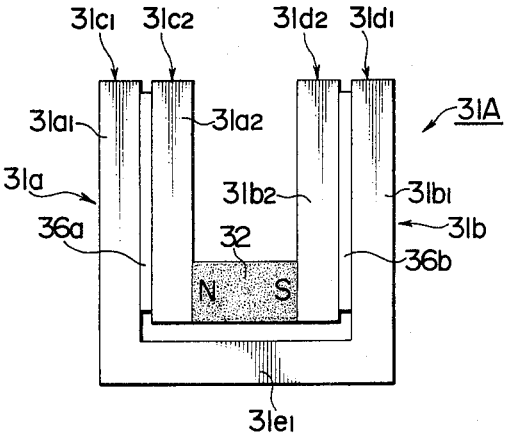
FIG. 10 is a front view of the magnet assembly shown in FIG. 9.

FIG. 9 shows a further embodiment of the release electromagnet of the invention. In this embodiment, both yokes are divided into a plurality of segments so that a path for the flux emanating from the permanent magnet is separate from a path for the flux produced by a current flow through the winding. However, both paths are connected together by a member of non-magnetic material interposed therebetween. Referring to FIGS. 9 and 10, the electromagnet comprises a permanent magnet assembly 31A which includes a pair of yokes 31*a*, 31*b*, each of which comprises sub-yokes 31*a*2, 31*b*2 to which the end faces, representing N- and S-poles, of a permanent magnet 32 are adhesively secured, and sub-yokes 31*a*1, 31*b*1 are secured to the outside of the sub-yokes 31*a*2, 31*b*2 with members of non-magnetic material 36*a*, 36*b* interposed therebetween. The member 36*a* or the member 36*b* may comprise a sheet of copper or aluminum. The magnet 32 is disposed between the lower ends of the sub-yokes 31*a*2, 31*b*2. Adhesives can be utilized to secure the members 36*a*, 36*b* to the outside of the sub-yokes 31*a*2, 31*b*2 or to secure the sub-yokes 31*a*1, 31*b*1 to the members 36*a*, 36*b*. Alternatively, fixing pins, not shown, may be formed on the members 36*a*, 36*b* to secure the corresponding parts together.

Upper end faces 31*c*1, 31*c*2, 31*d*1, 31*d*2 of the individual sub-yokes 31*a*1, 31*a*2, 31*b*1, 31*b*2 are flush and serve to attract an armature 33. Outer sub-yokes 31*a*1, 31*b*1 are connected together by a sub-yoke 31e1 on the opposite end from the end faces 31c1, 31d1. In this manner, the sub-yokes 31a1, 31b1, 31e1 collectively form a channel member. The members 36a, 36b provide magnetic isolation between the inner sub-yokes 31a2, 31b2 which adjoin with the permanent magnet 32 on one hand and the outer sub-yokes 31a1, 31e1, 31b1. As shown in FIG. 9, a winding 34 is disposed around sub-yokes 31a1, 31a2 to complete a release electromagnet. As shown, a spring 35 is anchored to the armature 33 to urge it away from the end faces of the sub-yokes.

When the winding 34 is not energized, flux from the permanent magnet 32 follows a closed path $a_1$ which includes sub-yoke 31a2, armature 33, and sub-yoke 31b2, thus attracting the armature 33 against the corresponding end faces. Flux from the permanent magnet also flows along a closed path $b_1$ indicated in dotted lines which include outer sub-yokes 31a1, 31e1 and 31b1, but the magnitude of such flux flow is greatly reduced compared with the flux prevailing in the path $a_1$ because of the increased path length and the non-saturable nature of the armature 33. Hence, the electromagnet strongly holds the armature 33 against the end faces 31c1, 31c2, 31d1 and 31d2.

When the winding 34 is energized to produce flux which is directed in a direction indicated by an arrow $b_1$, it follows a closed magnetic path $b_1$ which includes sub-yokes 31a1, 31e1, 31b1 and armature 33 in an efficient manner. This counteracts the flux of path $a_1$, allowing the armature 33 to be moved away from the end faces under the resilience of spring 35. The provision of separate paths enable the attracting flux to be efficiently maintained while allowing the counteracting flux to be efficiently passed through the armature 33.

Figure 11:
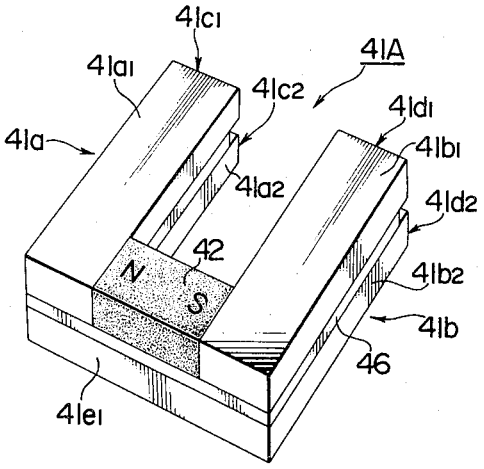
FIG. 11 is a perspective view of another form of magnet assembly.

FIG. 11 shows another form of permanent magnet assembly 41A. In this embodiment, yokes 41a, 41b are divided into segments 41a1, 41a2 and 41b1, 41b2, respectively, in the direction of their thickness. A permanent magnet 42 is disposed between the ends of sub-yokes 41a1, 41b1 and has its opposite end faces, representing N- and S-poles, adhesively secured to the sub-yokes 41a1, 41b1. The lower sub-yokes 41a2, 41b2 are connected together by a sub-yoke 41e1, thereby forming a channel member. The upper sub-yokes also form a channel member together with the permanent magnet 42, and these channel members are secured together with a thin sheet of non-magnetic material 46, again of a channel configuration, interposed therebetween. It will be noted that the thin sheet 46 is recessed slightly relative to the upper end faces 41c1, 41c2, 41d1, 41d2 of the sub-yokes 41a1, 41a2, 41b1, 41b2. This assembly 41A can be used in a similar manner and with a similar effect as that shown in FIG. 9.

Figure 12:
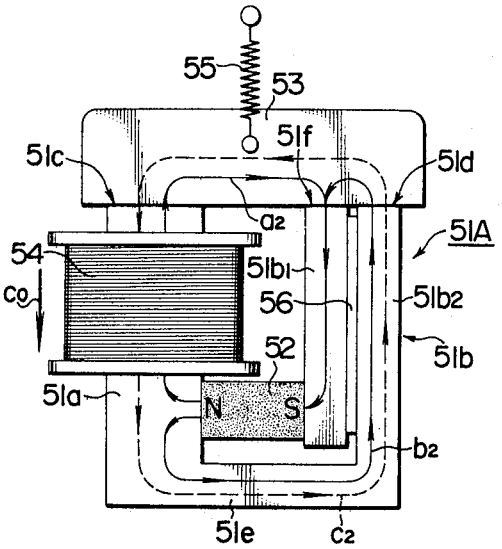
FIG. 12 is a front view of a release electromagnet according to an additional embodiment of the invention.
Figure 13:
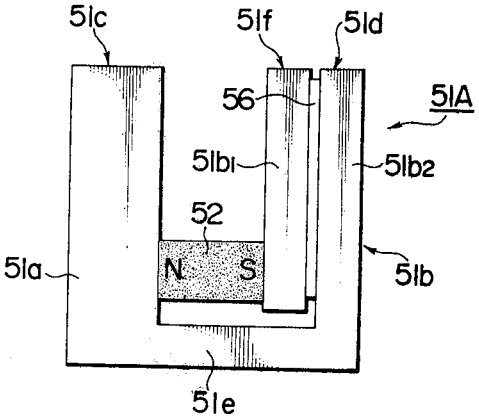
FIG. 13 is a front view of the magnet assembly shown in FIG. 12.

FIGS 12 and 13 show an additional embodiment of the invention. In this embodiment, one of the yokes is split into two segments, which are connected together through an interposed non-magnetic material, thus providing magnetic isolation. Specifically, a permanent magnet assembly 51A comprises a pair of yokes 51a, 51b between which the opposite end faces of a permanent magnet 52, representing N- and S-poles, are adhesively secured. Yoke 51b is split into two segments, namely, a sub-yoke 51b1 to which the magnet 52 is secured, and another sub-yoke 51b2 which is connected with the other yoke 51a. Thus, the yoke 51b is vertically split into two segments, the inner sub-yoke 51b1 being adhesively secured to one end face, representing the S-pole, of permanent magnet 52, and the other sub-yoke 51b2 including a connecting portion 51e extending to and integrally connected with the yoke 51a. In this manner, the outer sub-yoke 51b2, yoke 51a and connecting portion 51e collectively form a channel member. A member 56 of non-magnetic material such as copper or aluminum is interposed between the sub-yokes 51b1 and 51b2 which are integrally secured together as by an adhesion or by swaging of fixing pins, not shown, formed on the member 56.

Upper end faces 51c, 51d and 51f of the yoke 51a and sub-yokes 51b1 and 51b2 are flush with each other, serving to attract an armature 53 thereagainst. It will be seen that in the permanent magnet assembly 51A, the inner and outer sub-yokes 51b1 and 51b2 are completely magnetically isolated from each other. A winding 54 is disposed on the yoke 51a as shown in FIG. 12, thus completing a release electromagnet. As before, a spring 55 is anchored to the armature 53.

When the winding 54 is not energized, flux from permanent magnet 52 follows a path $a_2$ including yoke 51a, end face 51c, armature 53, end face 51f, sub-yoke 51b1 and back to permanent magnet 52. It also follows another closed path $b_2$ including yoke 51a, connecting portion 51e, sub-yoke 51b2, end face 51d, armature 53, end face 51f, sub-yoke 51b1 and back to permanent magnet 52. In this manner, the armature 53 is held attracted against the end faces 51c, 51d and 51f.

When the winding 54 is energized with a current flow which produces a flux indicated by an arrow $c_0$ in order to release the armature 53, the resulting flux follows a closed magnetic path indicated by an arrow $c_2$ shown in dotted lines, including yoke 51a, connecting portion 51e, sub-yoke 51b2, end face 51d, armature 53, end face 51c and yoke 51a. As a consequence, this flux counteracts the flux from the permanent magnet passing through the armature 53 as indicated by the arrow $a_2$, allowing the armature 53 to be moved away from the end face 51c initially, and then from the end faces 51f and 51d sequentially, under the resilience of spring 55. At the moment of armature 53 is moved away from the end face 51c, the flux continues to pass along the path $b_2$ including the end face 51f and a path portion which extends through the armature 53. However, after the armature 53 has moved away from the end face 51c, the resilience of spring 55 is sufficient to move it away from end faces 51f, 51d in a sequential manner. In other words, the force of attraction which remains at this time at the end faces 51f, 51d is overcome by the combined effect of the resilience of spring 55 and the demagnetization effect of the flux produced by the winding 54, thus achieving an efficient separation.

Figure 14:
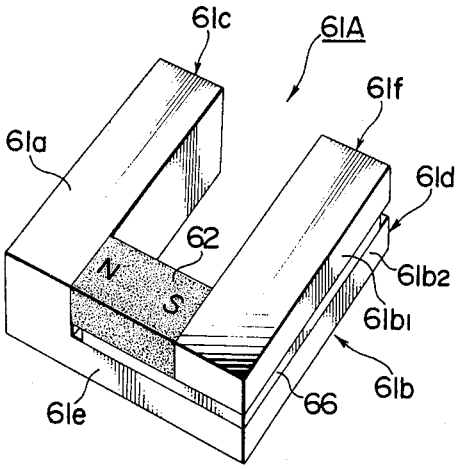
FIG. 14 is a perspective view of another form of magnet assembly.

FIG. 14 shows another form of permanent magnet assembly which may be used in the release electromagnet of the invention. Specifically, a permanent magnet assembly 61A includes a yoke 61b which is split into two segments 61b1, 61b2 in the direction of its thickness. The assembly 61A also includes another yoke 61a. An armature is adapted to held attracted against upper end faces 61c, 61d and 61f. A permanent magnet 62 is disposed between the lower ends of yoke 61a and sub-yoke 61b1, with its opposite end faces, representing N- and S-poles, being adhesively secured to the yoke 61a and sub-yoke 61b1. The lower sub-yoke 61b2 is connected with the bottom of the yoke 61a through a connecting sub-yoke 61e, thus forming a channel member together with components 61a, 61e. The lower sub-assembly comprising components 61e, 61b2 and the upper sub-assembly comprising components 62, 61b, both of a reversed L-configuration, are connected together with a member 66 of non-magnetic material, again of the similar configuration, interposed therebetween. It will be noted that the mumber 66 is slightly recessed from the end faces 61*f*, 61*d*. The described permanent magnet assembly operates in a manner similar to that of the release electromagnet shown in FIG. 12.

What is claimed is:

1. In a release electromagnet, including an armature; a first support member; a second support member; a permanent magnet disposed between said first and second support members, one pole of said permanent magnet being attached to said first support member and the other pole of said permanent magnet being attached to said second support member so that a first magnetic flux produced by said permanent magnet passes along a first flux path, including said first and second support members, and attracts an said armature to said first and second support members; electromagnetic means for producing a second magnetic flux which counteracts said first magnetic flux; and bypass means for cooperating with said first and second support members to provide a second flux path, along which a portion of said first magnetic flux passes, and for cooperating with said armature and said first and second support members to provide a third flux path, along which said second magnetic flux passes, said bypass means including a first bypass member, having a first face, and a second bypass member, having a second face adjacent to and spaced from said first face of said first member, the improvement wherein each of said first and second faces has a surface area which is substantially greater than the cross-sectional area of each of said first and second support members, said cross-sectional area being measured in a plane which is generally normal to the direction that said second magnetic flux and said portion of said first magnetic flux pass through said first and second support members, whereby magnetic saturation of said bypass means is inhibited.

2. A release electromagnet according to claim 1, wherein said first support member is L-shaped and includes a pair of generally perpendicular legs and said second support member is L-shaped and includes a pair of generally perpendicular legs, said first and second support members being arranged such that one of said legs of said first support member is generally parallel to and spaced from one of said legs of said second support member and the other legs of said first and second support members are arranged one above the other, said other leg of said first support member being spaced from and generally parallel to said other leg of said second support member.

3. A release electromagnet according to claim 1, further comprising a non-magnetic member interposed between said other leg of said first support member and said other leg of other said second support member.

4. A release electromagnet according to claim 1, wherein said electromagnetic means is disposed about said one leg of one of said first and second support members.

5. A release electromagnet according to claim 1, wherein said electromagnetic means is disposed about said other leg of said first support member and said other leg of said second support member.

6. A release electromagnet according to claim 1, wherein said permanent magnet is disposed between said one leg of said first support member and said one leg of said second support member.

7. A release electromagnet according to claim 1, wherein said first support member is L-shaped and includes a pair of generally perpendicular legs and said second support member is L-shaped and includes a pair of generally perpendicular legs, said first and second support members being arranged such that one of said legs of said first support member is generally parallel to and spaced from one of said legs of said second support member and the other legs of said first and second support members are arranged side by side, said other leg of said first support member being spaced from and generally parallel to said other leg of said second support member.

8. A release electromagnet according to claim 7, further comprising a non-magnetic member interposed between said other leg of said first support member and said other leg of said second support member.

9. A release electromagnet according to claim 7, wherein said electromagnetic means is disposed about said one leg of one of said first and second support members.

10. A release electromagnet according to claim 7, wherein said permanent magnet is disposed between said one leg of said first support member and said one leg of said second support member.

11. A release electromagnet according to claim 1, wherein said first support member includes a first generally L-shaped member, having a pair of generally perpendicular legs, and a first generally elongated member spaced from and generally parallel to one leg of said first L-shaped member and said second support member includes a second generally L-shaped member, having a pair of generally perpendicular legs, and a second generally elongated member spaced from and generally parallel to one leg of said second L-shaped member, the other leg of said first L-shaped member being attached to the other leg of said second L-shaped member in such a manner that said first and second L-shaped members form a generally U-shaped member.

12. A release electromagnet according to claim 11, wherein said electromagnetic means is disposed about said one leg of said first L-shaped member and said first elongated member.

13. A release electromagnet according to claim 11, wherein said first elongated member is adjacent to a side of said one leg of said first L-shaped member which faces said one leg of said second L-shaped member and said second elongated member is adjacent to a side of said one leg of said second L-shaped member which faces said one leg of said first L-shaped member.

14. A release electromagnet according to claim 13, further comprising a first non-magnetic member interposed between said one leg of said first L-shaped member and said first elongated member and a second non-magnetic member interposed between said one leg of said second L-shaped member and said second elongated member.

15. A release electromagnet according to claim 11, wherein said U-shaped member has a pair of generally planar U-shaped surfaces and said first and second elongated members are positioned adjacent to one of said planar U-shaped surfaces, said first elongated member being positioned adjacent said one leg of said first L-shaped member and said second elongated member being positioned adjacent said one leg of said second L-shaped member.

16. A release electromagnet according to claim 15, further comprising a generally U-shaped non-magnetic member interposed between said one planar U-shaped surface of said U-shaped member and said first and second elongated members.

17. A release electromagnet according to claim 11, wherein said permanent magnet is disposed between said first and second elongated members.

18. A release electromagnet according to claim 1, wherein said first support member is U-shaped and includes a pair of generally parallel legs which extend perpendicularly from a base and said second support member is spaced from and generally parallel to one leg of said U-shaped member.

19. A release electromagnet according to claim 18, wherein said electromagnetic means is disposed about the other leg of said U-shaped member.

20. A release electromagnet according to claim 18, wherein said permanent magnet is disposed between said second support member and the other leg of said U-shaped member.

21. A release electromagnet according to claim 18, wherein the other leg of said U-shaped member is thicker than said base and said one leg of said U-shaped member so that said U-shaped member has a generally planar L-shaped surface, said second support member being positioned adjacent said L-shaped surface and said one leg of said U-shaped member.

22. A release electromagnet according to claim 21, further comprising a generally L-shaped non-magnetic member interposed between said generally planar L-shaped surface of said U-shaped member and said second support member.

23. A release electromagnet according to claim 18, wherein said second support member is adjacent a side of said one leg of said U-shaped member which faces the other leg of said U-shaped member.

24. A release electromagnet according to claim 23, further comprising a non-magnetic member interposed between said one leg of said U-shaped member and said second support member.

* * * * *

UNITED STATES PATENT AND TRADEMARK OFFICE

CERTIFICATE OF CORRECTION

PATENT NO. : 4,321,570

DATED : March 23, 1982

INVENTOR(S) : Tsunefuji

It is certified that error appears in the above—identified patent and that said Letters Patent is hereby corrected as shown below:

Column 7, line 19, claim 1, after "and attracts" delete the word --an--.

Signed and Sealed this

Third Day of May 1983

[SEAL]

*Attest:*

GERALD J. MOSSINGHOFF

*Attesting Officer*

*Commissioner of Patents and Trademarks*